US009789593B2

(12) United States Patent
Kao

(10) Patent No.: US 9,789,593 B2
(45) Date of Patent: Oct. 17, 2017

(54) SOCKET RATCHET WRENCH

(71) Applicants: Chien-Chuan Kao, Taichung (TW); Chao-Chih Liu, Taichung (TW)

(72) Inventor: Chien-Chuan Kao, Taichung (TW)

(73) Assignees: Chien-Chuan Kao, Taichung (TW); Chao-Chih Liu, Taichung (TW)

( * ) Notice: Subject to any disclaimer, the term of this patent is extended or adjusted under 35 U.S.C. 154(b) by 324 days.

(21) Appl. No.: 14/604,150

(22) Filed: Jan. 23, 2015

(65) Prior Publication Data

US 2016/0214241 A1 Jul. 28, 2016

(51) Int. Cl.
*B25B 23/00* (2006.01)
*B25B 13/46* (2006.01)

(52) U.S. Cl.
CPC ..... *B25B 23/0035* (2013.01); *B25B 13/463* (2013.01)

(58) Field of Classification Search
CPC ..... B25B 23/00; B25B 23/0035; B25B 13/46; B25B 13/463
USPC ..... 81/60, 63
See application file for complete search history.

(56) References Cited

U.S. PATENT DOCUMENTS 837,537 A * 12/1906 Beyer ..... B25B 13/463 192/43.1
8,042,433 B2 * 10/2011 Chu ..... B25B 13/463 81/60
9,032,845 B2 * 5/2015 Lin ..... B25B 13/463 81/61
9,205,538 B2 * 12/2015 Yang ..... B25B 13/461
2004/0134313 A1 * 7/2004 Liu ..... B25B 13/463 81/63.2

* cited by examiner

*Primary Examiner* — Hadi Shakeri
(74) *Attorney, Agent, or Firm* — WPAT, P.C., Intellectual Property Attorneys; Anthony King

(57) ABSTRACT

A socket ratchet wrench includes a main body, a ratchet ring, a direction switching device, an upper cover, and a clamp member. Therein, the main body has a handle and a head, and the head has a first lateral side and an opposite second lateral side, with a first containing groove passing through therebetween and connected with a second containing groove. The ratchet ring is rotatably disposed in the first containing groove and has a polygonal inner bore for receiving a socket. The direction switching device is movably disposed in the second containing groove for unidirectionally driving the ratchet ring. The upper cover is fixed on the first lateral side. The clamp member is pivotally disposed on the upper cover, capable of pivotally swinging between a clamping position and a releasing position against the upper cover to optionally clamp or release the socket.

15 Claims, 7 Drawing Sheets

SOCKET RATCHET WRENCH

BACKGROUND OF THE INVENTION

1. Field of the Invention

The present invention relates to ratchet wrenches, and more particularly, to a socket ratchet wrench, which is operated in a manner of pressing to facilitate the removing of the socket from the ratchet wrench.

2. Description of the Related Art

A conventional ratchet wrench is mainly provided with a fix groove on the periphery of the socket, a ring groove on the inner periphery of the wrench body, and a C-clamp between the ring groove and the fix groove. When the socket is received by the wrench body, the C-clamp is resiliently engaged between the ring groove and the fix groove, whereby the socket is stably engaged on the head of the wrench body, such that the socket is prevented from departing from the wrench body during the operation.

However, the inner edge of the aforementioned ratchet is not present as a smooth surface, so that the manufacturing process of the ring groove thereof is difficult and complicated. Also, the C-clamp needs to be bended through a spring wire, such that the manufacturing process thereof is also difficult. In addition, elastic fatigue of the C-clamp is easily produced when the C-clamp is permanently disposed in the ring groove.

SUMMARY OF THE INVENTION

For improving the aforementioned issues, the present invention discloses a socket ratchet wrench, wherein a direction switching device thereof is provided with a rotation operation mode and a press operation mode. In the rotation operation mode, the ratchet ring is unidirectionally driven to rotate; in the press operation mode, the socket is able to depart from the ratchet wrench.

For achieving the aforementioned objective, the present invention provides a socket ratchet wrench, comprising:

a main body, provided with a handle and a head, the head having a first lateral side and an opposite second lateral side, a first containing groove passing through the first lateral side and the second lateral side, with one side of the first containing groove connected with a second containing groove;

a ratchet ring, rotatably disposed in the first containing groove, the ratchet ring provided with a polygonal inner bore for receiving a socket;

a direction switching device, movably disposed in the second containing groove for optionally engaging teeth of the ratchet ring for unidirectionally driving the ratchet ring to rotate;

an upper cover, fixed on the first lateral side; and a clamp member, pivotally disposed on the upper cover, capable of pivotally swinging between a clamping position and a releasing position for optionally clamping or releasing the socket.

Preferably, the direction switching device comprises a ratchet block and a direction switching member contained in the second containing groove for driving the ratchet block to engage the teeth thereof. Also, the direction switching member is allowed to ascend or descend along the axis of the second containing groove for optionally pushing the clamp member, such that the clamp member moves from the clamping position to the releasing position. Therefore, the direction switching member of the present invention is provided with a rotation operation mode and a press operation mode. In the rotation operation mode, the direction switching function is provided; in the press operation mode, the socket releasing function is provided. The operational structure of the present invention is simple and at the same time convenient for operation.

DETAILED DESCRIPTION OF THE INVENTION

Figure 1:
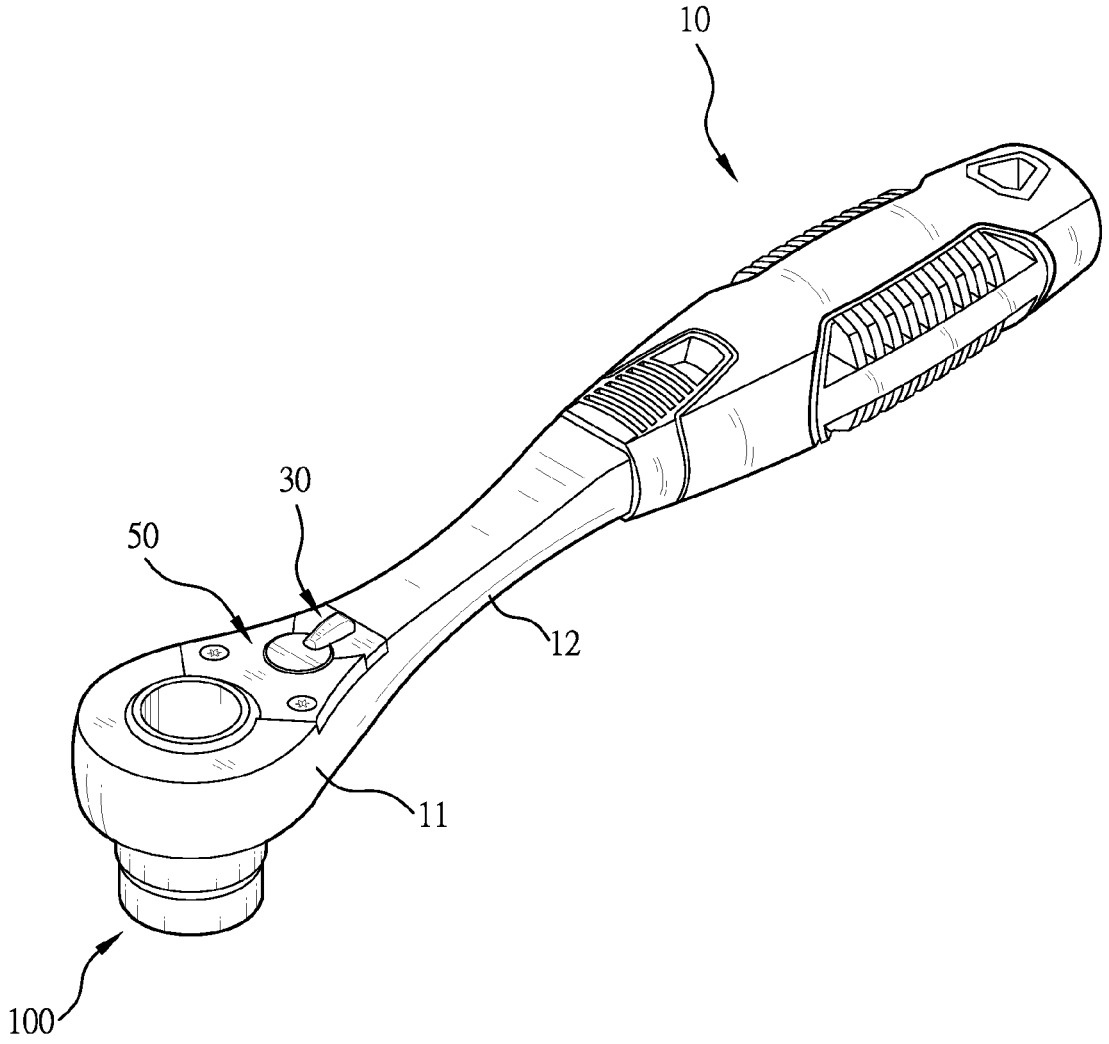
FIG. 1 is a perspective view of a socket ratchet wrench in accordance with the present invention.
Figure 2:
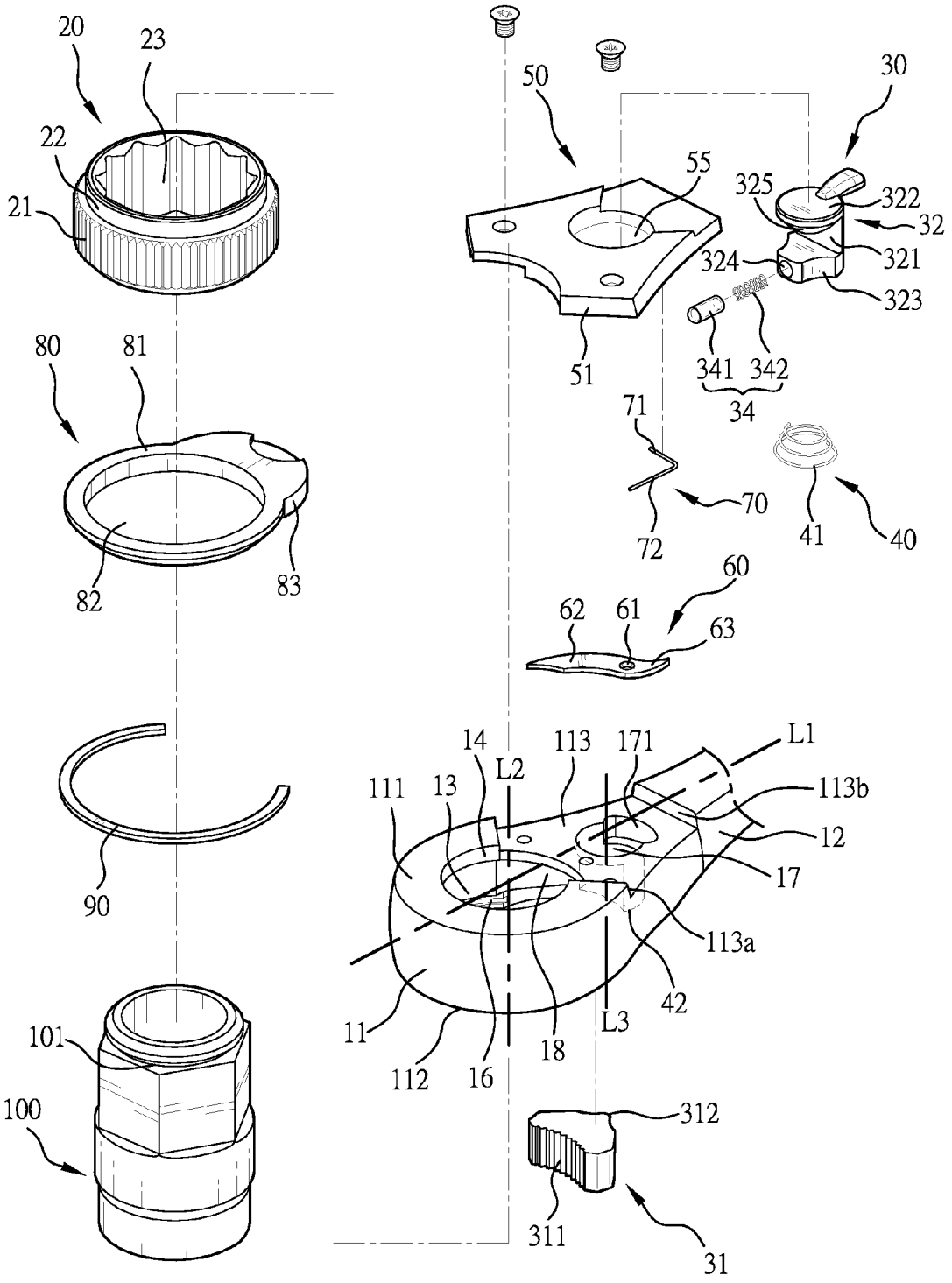
FIG. 2 is an exploded view of the socket ratchet wrench in accordance with the present invention.
Figure 3:
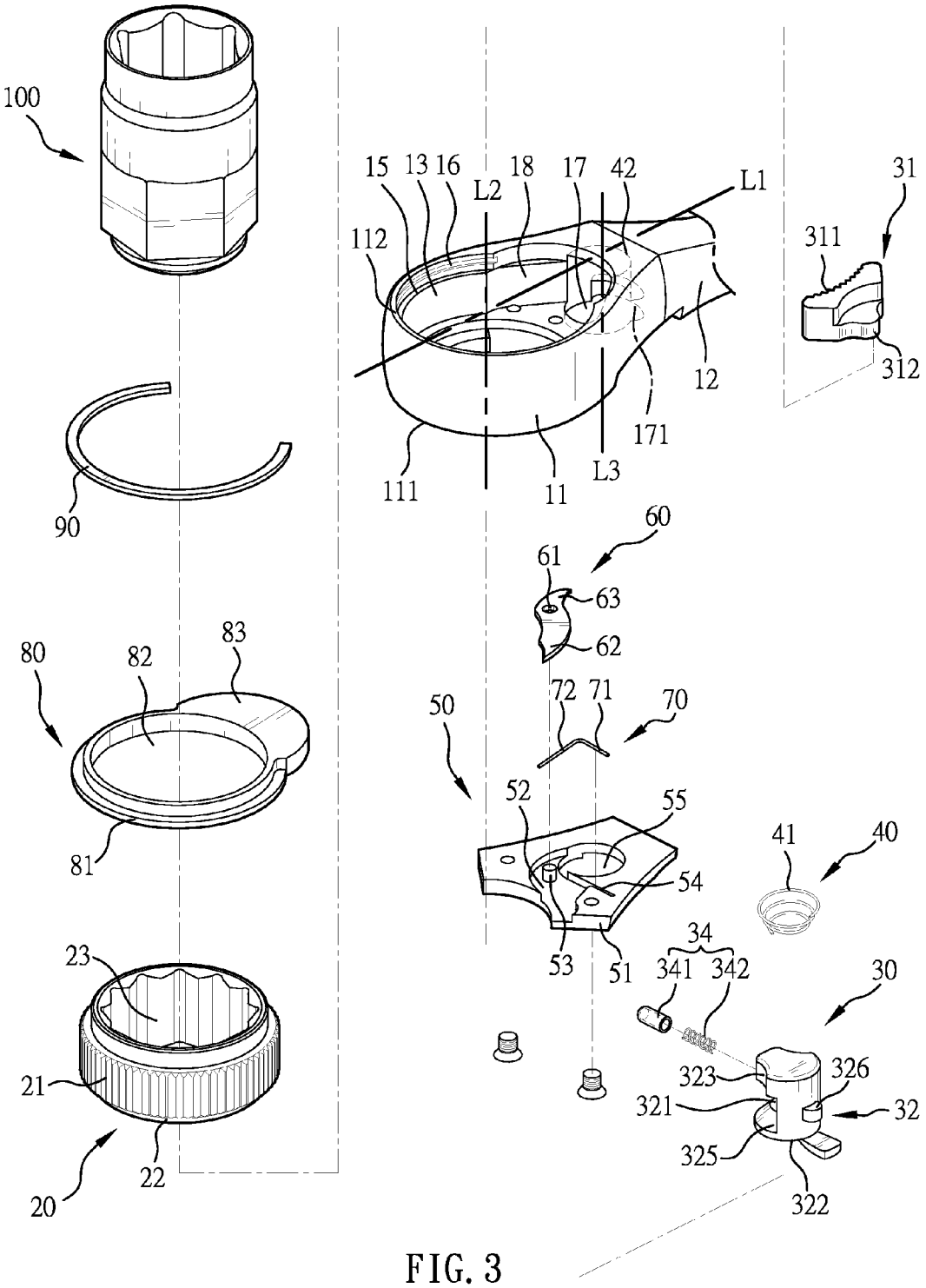
FIG. 3 is another exploded view of the socket ratchet wrench in accordance with the present invention illustrated from another view point.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 7, a socket ratchet wrench of the present invention comprises a main body 10, a ratchet ring 20, a direction switching device 30, an upper cover 50, and a clamp member 60, and an elastic member 70.

The main body 10 is provided with a head 11 and a handle 12, and the handle 12 is allowed to be mounted with a handgrip. The head 11 extends from one end of the handle 12. The handle 12 is in a rod shape and provided with an axis L1. The head 11 has a first lateral side 111 and an oppositely disposed second lateral side 112, with a first containing groove 13 passing through the first and second lateral sides 111,112. The first containing groove 13 is in a circular shape and provided with an axis L2 which is perpendicular to the axis L1. A first lateral groove 14 is disposed on the first containing groove 13 adjacent to the first lateral side 111; a second lateral groove 15 is disposed on the first containing groove 13 adjacent to the second lateral side 112, with an engage groove 16 disposed on an inner ring of the second lateral groove 15. Furthermore, a platform 113 is disposed on the first lateral side 111 adjacent to the handle 12, with two sides of the front edge of the platform 113 adjacent to the first containing groove 13 provided with a slope 113*a*, respectively, and the rear edge of the platform 113 provided with a rear face 113*b*.

A circular second containing groove 17 is concavely disposed on the platform 113 and connected to one side of the first containing groove 13 of the head 11. The second containing groove 17 has an axis L3 perpendicular to the axis L1; in other words, the axis L3 is parallel to the axis L2. In addition, a third containing groove 18 is disposed between and at the same time connected with the first containing groove 13 and the second containing groove 17. The third containing groove 18 is in a crescent shape, and the bottom face thereof is open and positioned at the same side with the second lateral groove 15, while a position limiting space 171 is concavely disposed at the rear side of the second containing groove 17.

The ratchet ring 20 is rotatably disposed in the first containing groove 13; in other words, the ratchet ring 20 is allowed to rotate against the axis L2. The outer periphery of the ratchet ring 20 is provided with a plurality of teeth 21. One end of the ratchet ring 20 has a extend portion 22 pivotally disposed on the first lateral groove 14 of the head 11. Also, the ratchet ring 20 is provided with a polygonal inner bore 23 for receiving a socket 100, as shown in FIG. 1.

The direction switching device 30 comprises a ratchet block 31 and a direction switching member 32. The ratchet block 31 is movably disposed in the third containing groove 18. The direction switching member 32 is movably disposed in the second containing groove 17, and capable of rotating against the axis L3 for enabling the ratchet ring 20 to carry out a unidirectional rotation.

Therein, the front lateral side of the ratchet block 31 is provided with a toothed portion 311 for optionally engaging the teeth 21. The rear lateral side of the ratchet block 31 is convexly provided with an install portion 312. The direction switching member 32 is provided with a rotation operational mode and a press operational mode, and a receiving portion 321 is disposed on the direction switching member 32 toward the ratchet block 31 for receiving the install portion 312 of the ratchet block 31. The upper end of the receiving portion 321 is provided with a operation portion 322 exposed on the second containing groove 17, and the lower end thereof is a bottom portion 323 having a hole 324 to receive a pushing device 34. The pushing device 34 comprises a pushing barrel 341 and a resilient member 342 therein. By use of the resilient member 342, the pushing barrel 341 pushes the rear lateral side of the ratchet block 31. Also, a circular slope 325 is disposed on the bottom edge of the operation portion 322 of the direction switching member 32 in the second containing groove 17. The rear end of the direction switching member 32 is provided with a convex block 326, such that the convex block 326 is allowed to be disposed in the position limiting space 171 for limiting the ascending and descending of the direction switching member 32, so as to achieve a positioning function. In the rotation operation mode, the direction switching member 32 rotates against the second containing groove 17, thereby triggering one side of the ratchet block 31 to engage the teeth 21. Therefore, the ratchet ring 20 is able to achieve a unidirectional driving function.

Therein, a reposition device 40 is installed in the second containing groove 17. In the embodiment provided by the present invention, the reposition device 40 is a spring 41 with the lower end thereof wider than the upper end thereof. Therein, the groove bottom of the second containing groove 17 is provided with a concave portion 42 for receiving the lower end of the spring 41, while the upper end of the spring 41 contacts the bottom face of the direction switching member 32, such that the reposition device 40 is sandwiched by the groove bottom of the second containing groove 17 and the bottom face of the direction switching member 32, thereby pushing the direction switching member 32 toward the platform 113. In other words, in the press operation mode, the operation portion 322 of the direction switching member 32 is pressed by an external force toward the axis L3. When the external force is larger than the prestress force of the reposition device 40, the direction switching member 32 is allowed to descend against the second containing groove 17. When the external force is removed, the direction switching member 32 is restored back to the original position, such that the direction switching member 32 ascends along the axis L3.

The upper cover 50 is fixed on the platform 113 and positioned at the same side with the direction switching member 32. Two sides of one end of the upper cover 50 are provided with an incline edge 51, respectively, for contacting the two slopes 113*a*, with the other end of the upper cover 50 contacting the rear face 113*b*. Furthermore, inner side of the upper cover 50 is provided with a recess 52, and a pillar 53 is formed in the recess 52 and parallel to the axis L2 and the axis L3, with one side of the pillar 53 provided with an insertion groove 54. In addition, the upper cover 50 is further provided with a first through hole 55 for the direction switching member 32 to pass through and expose from the operation portion 322.

The clamp member 60 is made by stamping and movably and pivotally disposed in the recess 52 of the upper cover 50. The clamp member 60 is able to swing against the upper cover 50 between a clamping position and a releasing position. The clamp member 60 has a positioning bore 61 for being pivotally mounted around the pillar 53. One end of the clamp member 60 is an engaging section 62 for engaging a ring groove 101 on one end of the socket 100, and the other end of the clamp member 60 is a pushing section 63. In the preferred embodiment, the length of the engaging section 62 is larger than the length of the pushing section 63.

The elastic member 70 is disposed in the recess 52 and present in an L shape. The elastic member 70 has a combining end 71 and a pushing end 72. The combining end 71 is inserted and fixed in the insertion groove 54, and the pushing end 72 laterally contacts the clamp member 60 for permanently pushing the clamp member 60, thus keeping the clamp member 60 at the clamping position. Therein, at the clamping position, the direction switching member 32 is pushed by the reposition device 40, so as to being permanently separated with the clamp member 60.

When in the press operation mode, the direction switching member 32 is able to drive the clamp member 60 to swing between a clamping position and a releasing position against the upper cover 50. For example, when the direction switching member 32 is pressed by an external force, the circular slope 325 of the direction switching member 32 pushes one side of the pushing section 63 of the clamp member 60, such that the clamp member 60 swings against the upper cover 50, whereby the clamp member 60 moves from the clamping position to the releasing position.

A lower cover 80 is provided with a combining portion 81 having a second through hole 82, wherein one side of the combining portion 81 has a holding cover 83. The combining portion 81 of the lower cover 80 is disposed in the second lateral groove 15, and the holding cover 83 is combined to the opening of the third containing groove 18 for preventing the ratchet block 31 from departing from the head 11. Also, the lower cover 80 is engaged in the engage groove 16 by a C-clamp 90, therein the second through hole 82 of the lower cover 80 is able to receive the socket 100.

Figure 4:
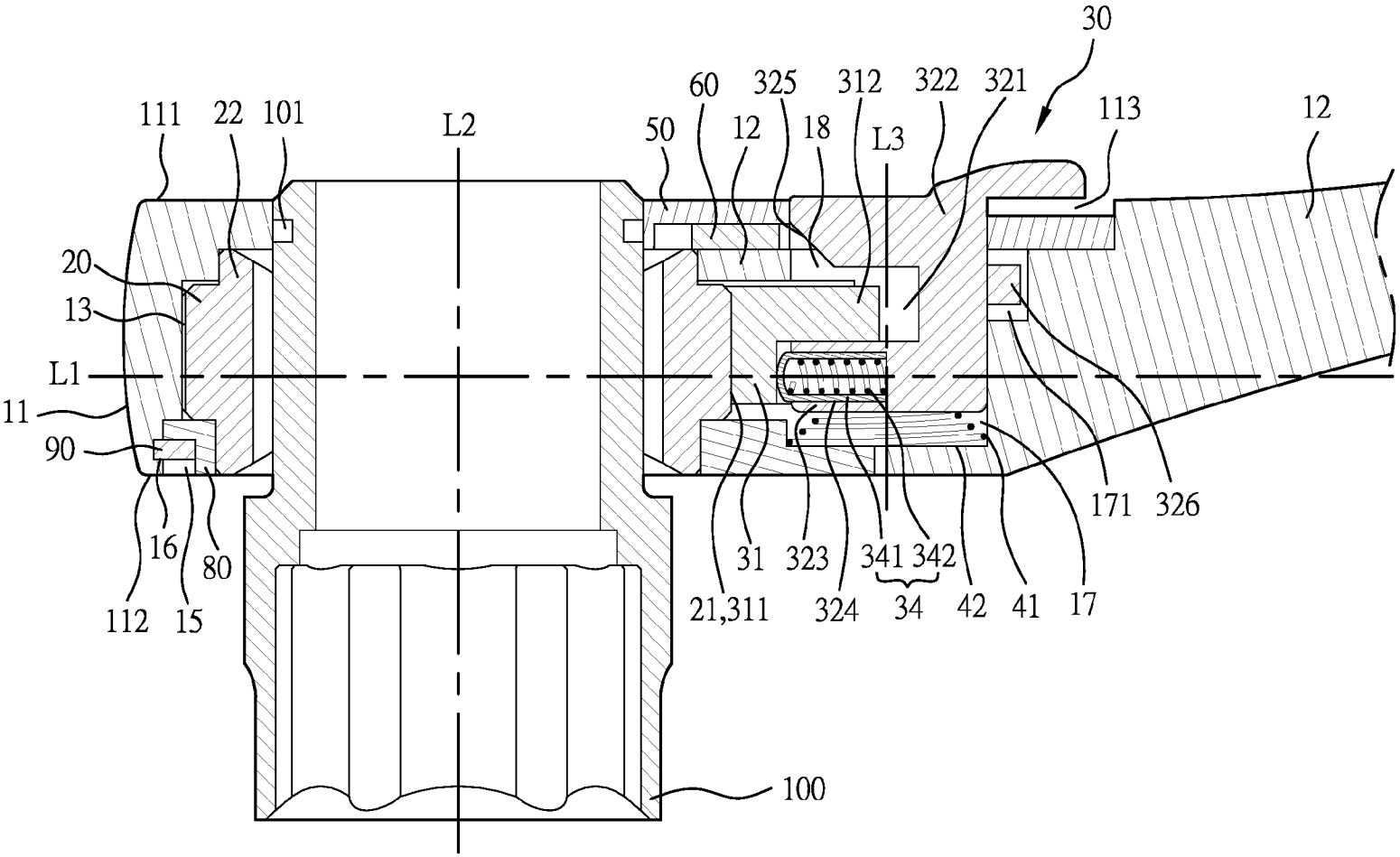
FIG. 4 is a sectional side view of the socket ratchet wrench in accordance with the present invention, illustrating the socket thereof combined to the head.
Figure 5:
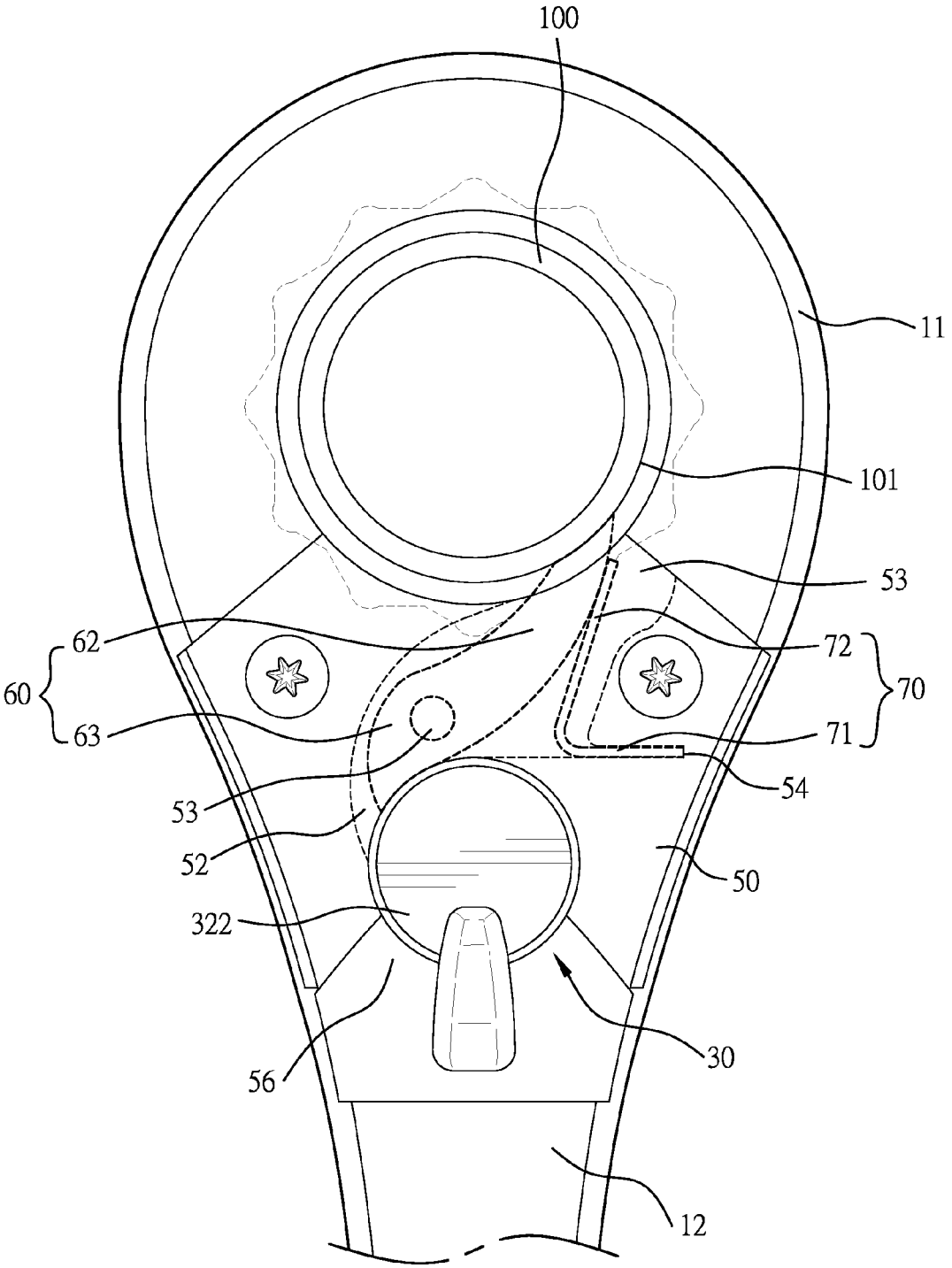
FIG. 5 is a schematic view of the socket ratchet wrench in accordance with the present invention, illustrating the clamp member thereof at the clamping position.

FIG. 4 and FIG. 5 illustrate the clamp member 60 at the clamping position. The clamp member 60 is pushed to the lateral side of the pushing section 63 by the pushing end 72 of the elastic member 70, whereby the clamp member 60 permanently leans against the outer side of the recess 52, so as to clamp the ring groove 101 of the socket 100. Thus, the socket 100 is stably received in the head 11 for facilitating the subsequent repairing or assembling operation.

Figure 6:
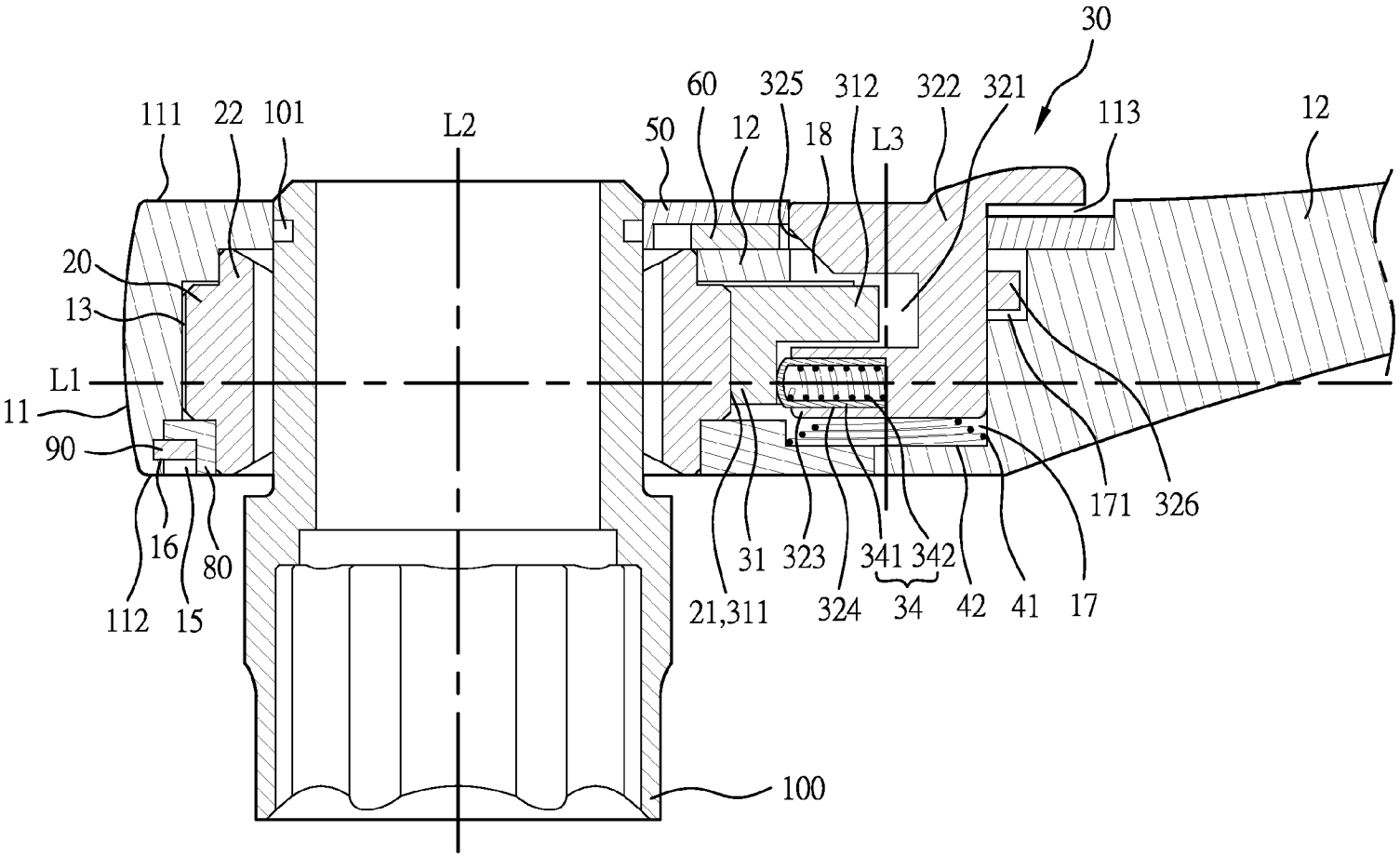
FIG. 6 is a sectional side view of the socket ratchet wrench in accordance with the present invention, illustrating the socket thereof departing from the head.
Figure 7:
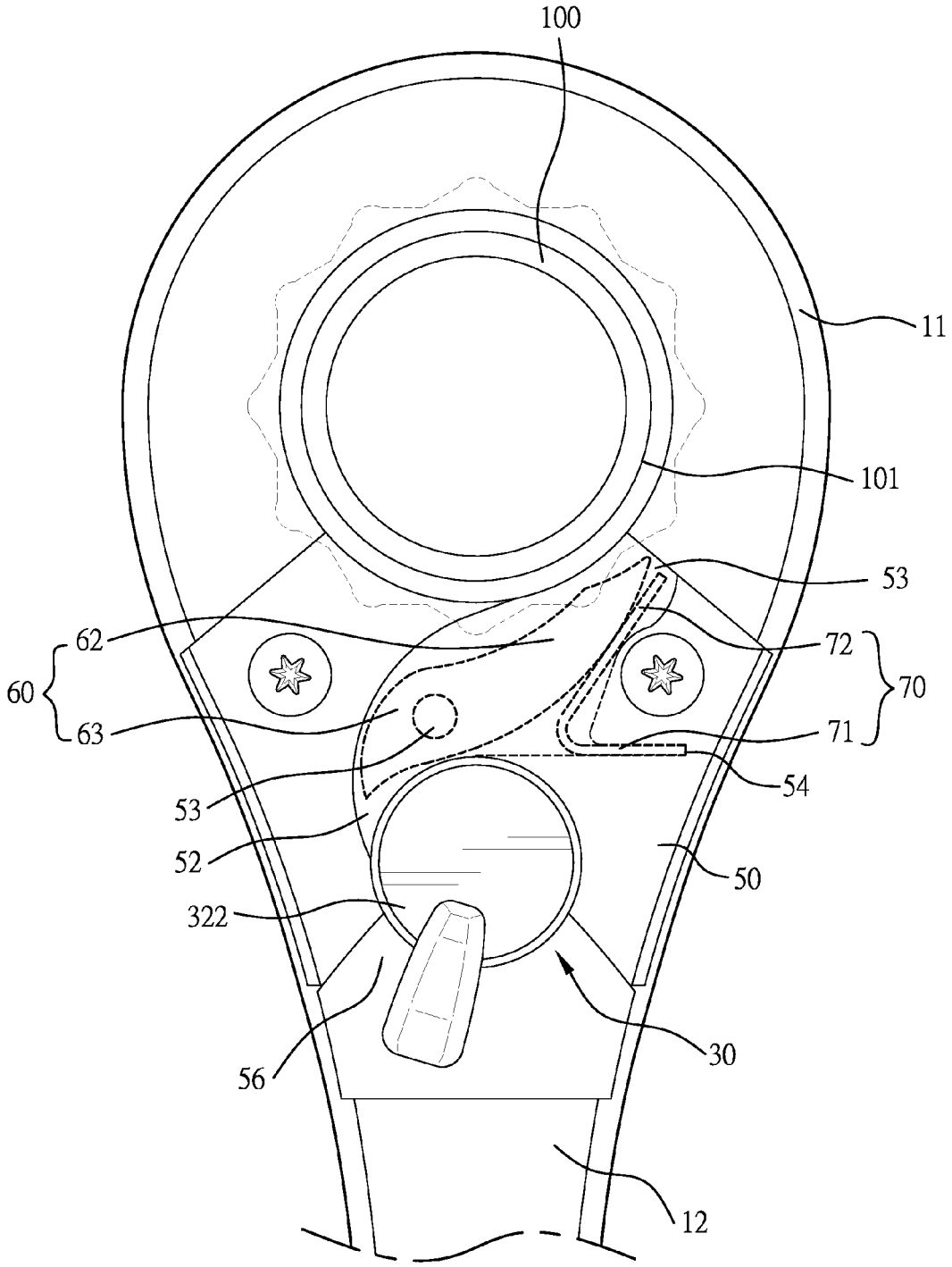
FIG. 7 is a schematic view of the socket ratchet wrench in accordance with the present invention, illustrating the clamp member thereof at the releasing position.

FIG. 6 and FIG. 7 illustrate the clamp member 60 at the releasing position. When the direction switching member 32 is pressed by an external force imposed from the direction in axial alignment with the axis L3, the direction switching member 32 descend against the second containing groove 17, so as to compress the spring 41, and push the pushing section 63 of the clamp member 60 by use of the circular slope 325 of the operation portion 322 on the direction switching member 32. Thus, the clamp member 60 swings in the recess 52 with the pillar 53 as the pivot axle, whereby the engaging section 62 of the clamp member 60 moves away from the socket 100, so as to facilitate the removing of the socket 100 from the head 11.

Therein, due to the length of the engaging section 62 of the clamp member 60 larger than the length of the pushing section 63, the force imposing point is closer to the pivoting center, saving time demand. In other words, through pressing the direction switching member 32, the clamp member 60 is allowed to depart from the socket 100, achieving the advantage of efficiently removing the socket 100.

Therefore, the present invention applies the clamp member 60 made by stamping, and clamps the socket 100 in a manner of swinging to clamp. Compared with the conventional C-clamp, the clamp member 60 of the present invention does not need to be bent to be combined in the ratchet ring 20, thus facilitating the manufacturing process. Also, the direction switching member 32 is applied as a component not only for changing the operation directions, but also for clamping or releasing the socket 100, such that an additional switch is not needed to be provided for controlling the clamp member 60, thus being convenient to be operated and simplifying the components of the present invention.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket ratchet wrench for receiving a socket, comprising:

a main body, provided with a handle and a head, the head having a first lateral side and an opposite second lateral side, a first containing groove passing through the first lateral side and the second lateral side, with one side of the first containing groove connected with a second containing groove;

a ratchet ring, rotatably disposed in the first containing groove, a plurality of teeth provided on the outer periphery of the ratchet ring, while the ratchet ring is provided with a polygonal inner bore for receiving the socket;

a direction switching device, movably disposed in the second containing groove for unidirectionally driving the ratchet ring to rotate, wherein the direction switching device further comprises a ratchet block and a direction switching member in the second containing groove for driving the ratchet block to engage the teeth;

an upper cover, fixed on the first lateral side; and a clamp member, pivotally disposed on the upper cover, capable of pivotally swinging between a clamping position and a releasing position against the upper cover, so as to clamp the socket in the inner bore at the clamping position and depart from the socket at the releasing position for releasing the socket from the inner bore;

wherein the direction switching member ascends and descends along an axis of the second containing groove for optionally pushing the clamp member, such that the clamp member moves from the clamping position to the releasing position.

2. The socket ratchet wrench of claim 1, wherein a third containing groove is disposed between and at the same time connected with the first containing groove and the second containing groove, while the ratchet block is movably disposed in the third containing groove.

3. The socket ratchet wrench of claim 1, wherein a reposition device is installed in the second containing groove for pushing the direction switching member, such that the direction switching member is permanently separated with the clamp member.

4. The socket ratchet wrench of claim 3, wherein the reposition device is a spring, and one end of the spring contacts a bottom face of the direction switching member, while the groove bottom of the second containing groove is provided with a concave portion for receiving the other end of the spring.

5. The socket ratchet wrench of claim 1, wherein a recess is disposed on the inner side of the upper cover for movably and pivotally receiving the clamp member at the clamping position.

6. The socket ratchet wrench of claim 5, wherein an elastic member is disposed in the recess for permanently pushing the clamp member and keeping the clamp member at the clamping position.

7. The socket ratchet wrench of claim 6, wherein the elastic member is provided with a combining end and a pushing end, while the pushing end laterally contacts the clamp member, with an insertion groove disposed in the recess for the combining end of the elastic member to be inserted and fixed therein.

8. The socket ratchet wrench of claim 5, wherein a pillar is disposed in the recess, and the clamp member is provided with a positioning bore to be mounted around the pillar.

9. The socket ratchet wrench of claim 8, wherein a ring groove is disposed on the periphery of the socket, while one end of the clamp member is an engaging section for engaging the ring groove and the other end of the clamp member is a pushing section; the direction switching member is provided with an operation portion exposed from the second containing groove, and a bottom edge of the operation portion is provided with a circular slope for pushing the pushing section.

10. The socket ratchet wrench of claim 9, wherein the length of the engaging section is larger than the length of the pushing section.

11. The socket ratchet wrench of claim 1, wherein a platform is disposed on the first lateral side adjacent to the handle for receiving the upper cover.

12. The socket ratchet wrench of claim 1, wherein a receiving portion is disposed on a front end of the direction switching member, and a front lateral side of the ratchet block is provided with a toothed portion for engaging the teeth; a rear lateral side of the ratchet block convexly provided with an install portion for being received by the receiving portion.

13. The socket ratchet wrench of claim 12, wherein a lower end of the receiving portion has a bottom portion, and the bottom portion is provided with a hole for receiving a pushing device, while the pushing device pushes the rear lateral side of the ratchet block.

14. The socket ratchet wrench of claim 1, further comprising a lower cover having a second through hole for receiving the socket, while the lower cover is engaged in the first containing groove adjacent to the second lateral side by a C-clamp.

15. A socket ratchet wrench for receiving a socket, comprising:

a main body, provided with a handle and a head, the head having a first lateral side and an opposite second lateral side, a first containing groove passing through the first lateral side and the second lateral side, with one side of the first containing groove connected with a second containing groove, a third containing groove disposed between the first and second containing grooves, and a platform disposed on the first lateral side adjacent to the handle;

a ratchet ring, rotatably disposed in the first containing groove, a plurality of teeth provided on the outer periphery of the ratchet ring, while the ratchet ring is provided with a polygonal inner bore for receiving the socket;

a direction switching member, movably disposed in the second containing groove and having a rotation operation mode and a press operation mode;

a ratchet block, movably disposed in the third containing groove, such that the direction switching member, when in the rotation operation mode, drives the ratchet block to engage the teeth for unidirectionally driving the ratchet ring to rotate;

an upper cover, fixed on the platform and placed on the same side with the direction switching member; and a clamp member, pivotally disposed on the upper cover, driven by the direction switching member to pivotally swing between a clamping position and a releasing position against the upper cover when the direction switching member is in the press operation mode, so as to clamp the socket in the inner bore at the clamping position and depart from the socket at the releasing position for releasing the socket from the inner bore.

* * * * *